United States Patent [19]

Marquaire et al.

[11] 4,023,619

[45] May 17, 1977

[54] METHOD OF CONNECTING OF AN UNDERSEA CENTRAL STATION TO A GROUP OF UNDERSEA WELLS AND OUTFLOW PIPES

[75] Inventors: Roger Andre Marie Marquaire, La Celle St. Cloud; Michel Georges August Curtis, Lyon, both of France; Robert Edouard Schappel, London, England

[73] Assignee: Subsea Equipment Associates Limited, Hamilton, Bermuda

[22] Filed: Apr. 7, 1975

[21] Appl. No.: 565,971

[30] Foreign Application Priority Data

Apr. 5, 1974 France ..... 74.12175

[52] U.S. Cl. ..... 166/.6; 61/98; 61/97; 61/88; 61/90

[51] Int. Cl.² ..... E21B 33/035

[58] Field of Search ..... 166/.5, .6; 61/46.5, 61/69 A

[56] References Cited

UNITED STATES PATENTS

| | | | |
|---|---|---|---|
| 3,211,223 | 10/1965 | Hoch | 166/.6 |
| 3,307,627 | 3/1967 | Shatto, Jr. | 166/.6 |
| 3,604,731 | 9/1971 | Peterson | 166/.6 |
| 3,710,859 | 1/1973 | Hanes et al. | 166/.6 |
| 3,716,100 | 2/1973 | Nelson | 166/.6 |
| 3,846,992 | 11/1974 | Liautaud | 166/.6 |
| 3,855,806 | 12/1974 | Le Therisien | 166/.5 |
| 3,866,677 | 2/1975 | Baugh | 166/.6 |

*Primary Examiner*—James A. Leppink

*Attorney, Agent, or Firm*—Sughrue, Rothwell, Mion, Zinn & Macpeak

[57] ABSTRACT

A method and apparatus for connection of a central undersea station to a group of wells and outflow pipes is disclosed. The undersea station locks onto a platform which has a series of guides and locking devices to receive and lock the station relative to itself as well as to other locations for the installation of wellheads which are to be ultimately serviced by the station. The method essentially comprises that prior to the connection of the wells and the pipes a guide member is installed on the platform between the location of the station and each of the locations of the wells or pipes and then the central station is lowered and is provided a lateral connection device such that when the platform is locked into position, the lateral connection device is opposite the guide on the platform. Placing structures are lowered onto other locations and a connecting structure is generally lowered by means of a diving bell which rests in a watertight manner on a bearing surface of a connecting structure which orientates the bell so that the structure presents a lateral connection cooperating between the guide means of the platform and a connector which insures the water tightness of the well or pipe. Manual connections inside the bell of a subassembly to the lining of the well or pipe are achieved and at least one pipe system between the subassembly and the lateral connection on the structure to insure continuity of the lining or of the pipe with the lateral connection means is disclosed. When this lateral connection device has been joined with the connection structure of the station, the bell is then brought to the surface.

12 Claims, 9 Drawing Figures

Figure 1:
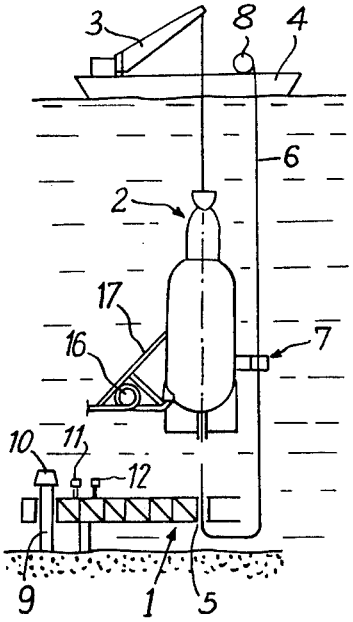

METHOD OF CONNECTING OF AN UNDERSEA CENTRAL STATION TO A GROUP OF UNDERSEA WELLS AND OUTFLOW PIPES

The invention concerns a method of connection of an undersea central station to a group of undersea wells of which it ensures the control and to at least one pipe for outflow of the petroleum products gathered at the station or from outflow pipes proceeding from wells further away, particularly when the depth may be greater than that which can be reached by a diver.

A method of construction of a central station of this type is known but the grouping necessitates the lowering of special wellheads making possible their grouping to the central station only at the price of installation of numbers of guidelines, the construction of costly connection means, possible intervention of submarines and the necessity of effecting numerous remotely controlled operations rendering the placing of each wellhead or each outflow pipe as well as the connection to the central station lengthy and costly.

According to the present invention there is provided a method of connection of a central undersea station to a group of wells and outflow pipes, wherein the station locks onto a platform provided with guide and locking means for receiving and locking said station relative thereto as well as locations for the installation of wellheads serviced by the station, said method comprising prior to connection of the wells and the pipes installing at least one guide means on said platform between the location of said station and each of the locations of said wells or pipes, lowering said central station which is provided with lateral connection means so that when said platform is locked in position said lateral connection means are opposite said guide means on said platform, lowering onto said other locations at least one placing structure and at least one connecting structure, said connecting structure being lowered by means of a diving bell resting in a watertight manner on a bearing surface on said connection structure orientating said bell so that said structure presents a lateral connection means co-operating with said guide means on the said platform and a connector ensuring watertightness of the well or the said pipe with said structure, manually connecting inside said bell a sub-assembly to the lining of said well or to said pipe and at least one pipe system between said sub-assembly and said lateral connection means on said structure so as to ensure continuity of said lining or of said pipe with said lateral connction means, controlling joining of said connection means on the structure to said lateral connection means on the said central station and thereafter raising said bell.

In a preferred method of connection of an undersea central station to a group of wells and outflow pipes platforms are employed to define the locations of the wellheads with respect to the central station and means of automatic locking are used which are controlled simply by tensioning cables, wherein having installed the platform on which is provided at least one guide means between the well in question and a lateral connection means of the station to the well, the station is lowered from the surface whilst it is orientated with respect to the guide means so that when the station locks itself onto the platform its means of lateral connection to the well is aligned with respect to the well, a connecting structure provided with a lateral connection device is lowered from the surface using a guide and removely controlled device, this structure being adapted to lock itself in a watertight manner onto the casing of the well, and is to be connected laterally to the said connection means of the wall and to receive on its periphery the base of diving bell supported by a handling means which is guided by the guide and remotely control means, the bell containing a sub-assembly comprising at least one master valve, the bell is orientated so that the lateral connection device on the connecting structre is pointed towards the guide means on the platform, inside the bell a work crew connects the said sub-assembly to the lining head and the master valve to the lateral connection device on the structure and when this lateral connection device has been joined up with the lateral connecting means of the station, the bell is brought to the surface.

Thus whatever the depth a single intervention by means of a diving bell is sufficient for connecting a well to a suitable orientated central undrsea station.

In a preferred method of connecting the central station to an outflow pipe location is provided on the platform for joining up the pipe and guide means between the joining-up place and the means of lateral connection of the said central station to the junction, a structure is lowered onto the location on the platform for placing a frame which carries an articulated connector which is orientated with respect to the guide means on the platform the frame is lowered while its articulated connector is attached to the end of the outflow pipe and is so guided and orientated that it locks itself onto the placing structure, lowering and laying of the pipe in the direction chosen is continued so that at the end of the laying operation the articulated connector has pivoted through an angle of 90°, by means of a guide and remotely control device a connector device is lowered which is adapted to lock itself in a watertight manner onto the free portion of the articulated connector after its pivoting through 90° and for lateral connection to the means of connection of the station and for receiving on its periphery the base of a diving bell supported by a handling means which is guided by the guide and remotely control means, the bell containing a sub-assembly comprising if required a master valve, the said bell is orientated so that the lateral connection device of the connector is pointed towards the guide means on the platform, inside the bell a work crew connects the sub assembly to the free portion of the titled connector and the said master valve (if provided to the lateral connection device and, when the lateral connection device has been joined with the connection means of the station, the said bell is brought to the surface.

The above desired method therefore enables either connection of the station to an ordinary pipe serving for the outflow of the products gathered at the station, or connection or the station to a relatively distant well which is connected by means of a pipe starting from the station.

The invention will be more fully understood from the following description of an embodiment thereof given by way of example only with reference to the accompanying drawings.

Figure 2:
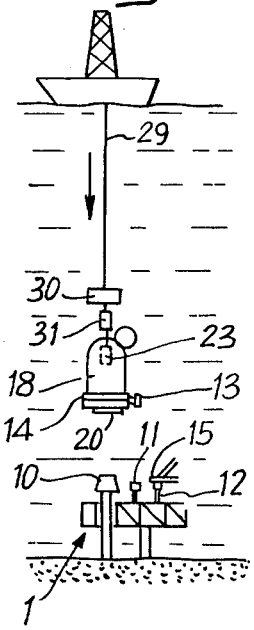
Figure 3:
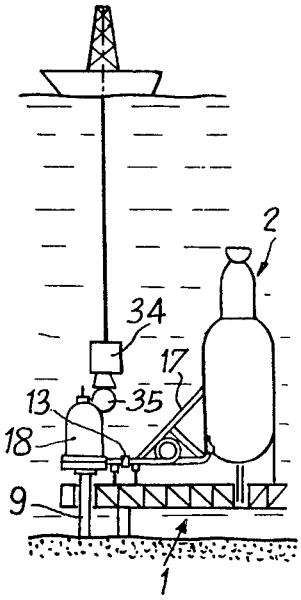
Figure 4:
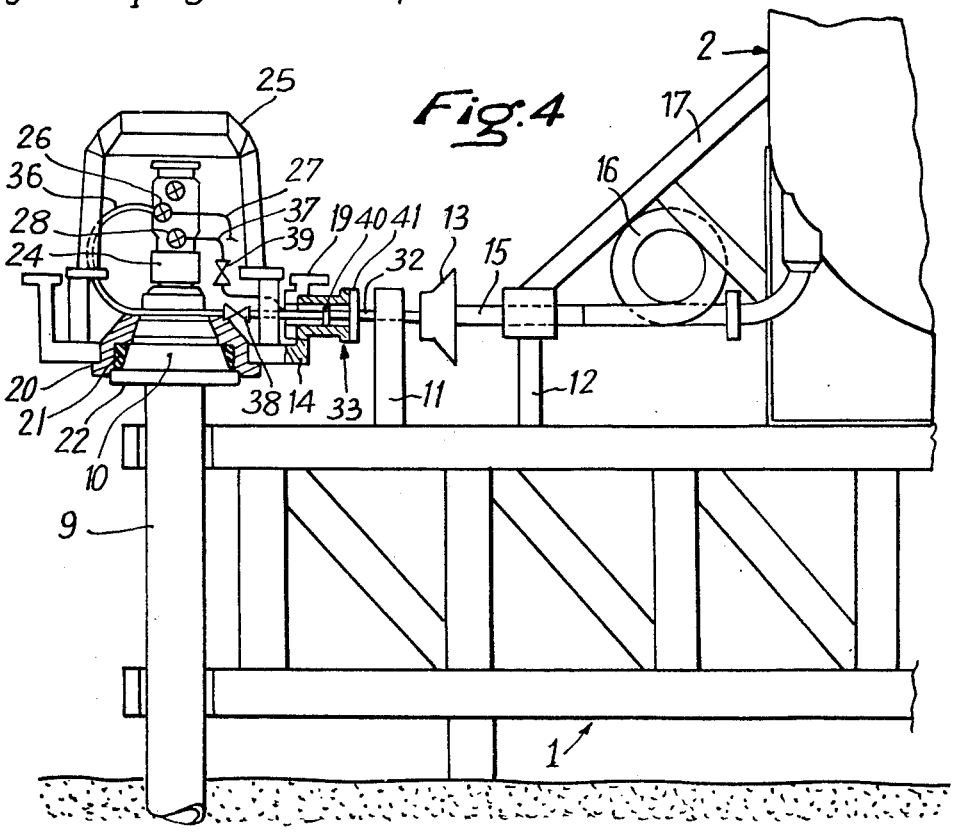
Figure 5:
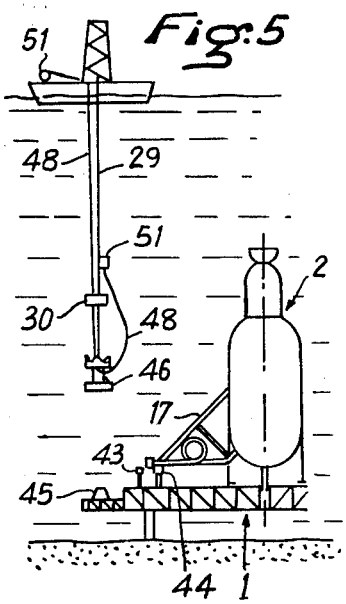
Figure 6:
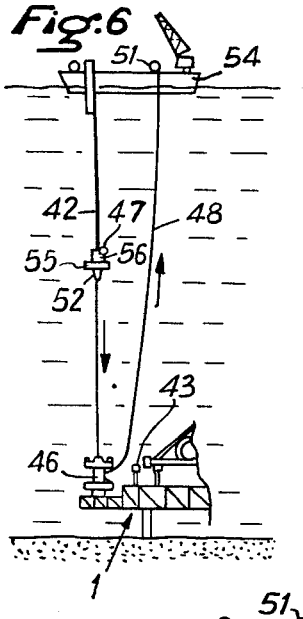
Figure 8:
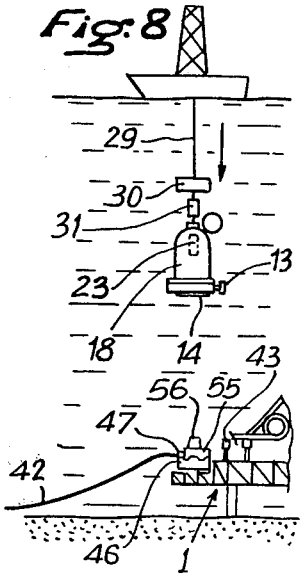
Figure 7:
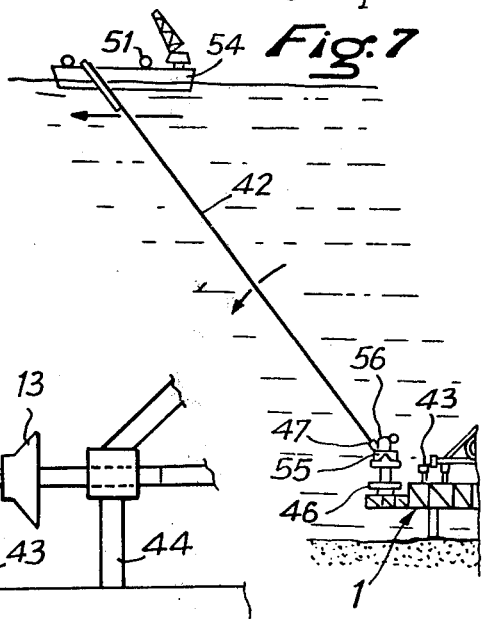
Figure 9:
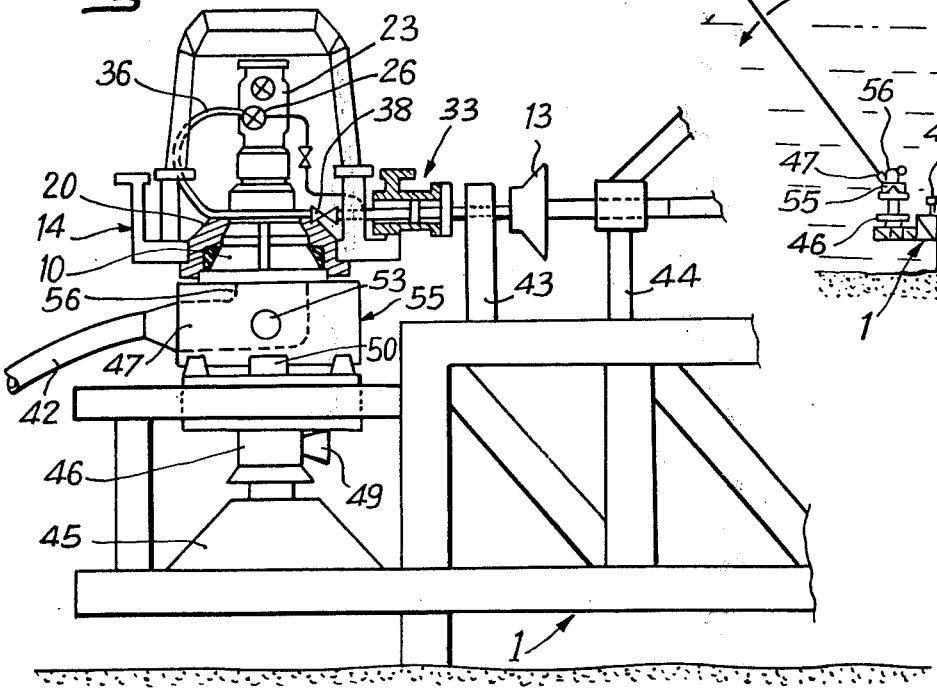

In the drawings:

FIG. 1 is a diagrammatic view showing the placing of a central station on its platform, FIG. 2 is a diagrammatic view showing the placing of connecting structure on the well, FIG. 3 is a diagrammatic view showing the joining up of the connection means on the connecting structure and on the central station, FIG. 4 is a diagramatic view partially cut away of the central station connected to the connecting structure of the well, FIG. 5 is a diagrammatic view showing the lowering of a structure for placing the connection means for an outflow pipe, FIG. 6 is a diagrammatic view showing the placing of the orientatable connector attached to the end of the outflow pipe, FIG. 7 is a diagrammatic view showing the placing of the outflow pipe, FIG. 8 is a diagrammatic view showing the placing of the connecting structure on the central station, and FIG. 9 is a diagrammatic view partialy cut away of the central station connected to the connecting structure of the outflow pipe.

As shown in the drawings, a platform 1 onto which a central station 2 is lowered with the aid of handling means 3 from a surface vessel e.g. a barge 4, includes conventional means (not shown) for locking the station onto the platform. Guide means shown diagrammatically at 5 enable a cable 6 passing through a guide arm 7 to bring the station 2 onto its locking means when it is tightened by winch 8.

The platform 1 surrounds the casing 9 of a well serviced by the station 2. A simple guide support or a male connector 10 enables subsequent connection of any required structure. Two guide means 11 and 12 are respectively provided on the platform to ensure correct joining up of a connector for a lateral connection 13, FIG. 4 on a connecting structure 14 and of a connector 15 of a connecting pipe 16 on the station 2 to the well in question. This connecting pipe is supported by a frame 17 fixed to the station 2. The connecting pipe 16 is preferable a flexible pipe forming a large enough loop for the passage, if necessary, of intervention tools into the well and for facilitating connection. The guide means 11 and 12 may be of any types such as ordinary frames or connectors which are automatic after joining up of the connector 13 and the connector 15.

After the station 2 has been lowered and locked onto the platform 1 in an orientation such that the connector 15 on the connecting pipe 16 rests against the guide means 12 of the platform 1, the connecting structure 14 is coupled to a bell 18 the base of which rests against a bearing surface 19, FIG.4 of the structure 14. This structure also includes a female connector 20 and a flexible watertightness means 21 which ensures, when the female connector 20 is resting on the flange 22 of the male connector 10, water-tightness of the volume formed by the bell 18, the connecting structure 14 and the casing 9. The bell 18 contain a sub-assembly 23 provided with a connctor 24 for locking onto the lining which surrounds in a watertight fashion the male connector 10 and a guide and protective structure 25. The sub-assembly 23 includes a mastervalve of which the control is shown diagrammatically at 26. It may also contain all the conventional pipe systems for hydraulic controls shown diagrammatically at 27 as well as any other value usual at a wellhead, such as a valve the control of which is shown diagramatically at 28, this valve being inserted in the ring circuit, for example. Lowering of the bell 18 is effected by a riser 29, a conventional guide and remote control device 30 suspended from the riser, this device 30 employing, for example, sonar devices, and a handling tool 31 directly connected to the bell 18. The device 30 enables correct orientation of the bell 18 and consequently of the connecting structure 14 so that lateral connecting pipe system 32 is guided by the guide means 11 on the platform 1.

As shown the connector 13 of the connecting pipe system 32 then lies on the side of the guide means 11 opposite a device for control of a lateral connection 33.

If the bell 18 does not include a chamber for transfer of a work crew, an auxiliary chamber 34 (FIG.3) is lowered, this chamber 34 being provided with its own guide means to join it onto the bell 18 by means of an airlock 35. The crew then proceeds with the joining up of the sub-assembly 23, with the connection of the hydraulic control pipe systems 27 and the pipe systems 36 and 37 connected respectively to the valves controlled at 26 and 28. The pipe systems 36 and 37 terminate in auxiliary valves 38 and 39 connected to the device for control of the lateral connection 33. The latter comprises a cylinder 41 inside which slides a piston 40 fast with a tube 32 this tube being single or formed of a number of pipe systems, each of which is connected to an auxiliary valve 38 or 39, for example. It is therefore sufficient for the work crew to control the displacement of the piston 40 by means of hydraulic control circuits (not shown) opening into the cylinder 42 and fed by the equipment in the bell 18, in order to displace the connector 13 which has the shape of a guide cone at the end of the connector 32 having single or multiple piping. In this way connection is effected between the connector 13 and the connector 15 of the single pipe 16 from the station 2.

It is then sufficient for the crew to check satisfactory operation of the connection from the wellhead to the central station and to return to the surface by means of the auxiliary chamber 34. After raising of the bell 18 the assembly then appears as shown diagrammatically in FIG. 4.

Connection of the central statiion 2 to an outflow pipe 42, FIG. 9, is effected in a manner similar to that which has just been described. The portion of the platform 1 corresponding with the location of the connection from the outflow pipe to the station 2 lies, just as for the connection from a well, opposite guide means 43 and 44, FIG. 5 identical with the means 11 and 12. Onto a base 45, which is provided with orientation means there is lowered a structure 46 for placing a tilting connector 47 and the structure 46 is acompanied by a cable 48 passing through a channel in this structure with openings 49 and 50. One end of the cable 48 is wrapped round a winch 51, the other end 52 being attached temporarily to the riser 29. A guide and remote control device 30 ensures the placing of structure 46 on the base 45. As this base is provided with orientation means the structure 46 is thus correctly orientated. Its upper portion is provided with means for assembling and/or locking frame 55 upon which the connector 47 pivots about axis 53.

When the end 52 of the cable 48 has been brought back to the surface, the winch 51 may, if necessary, be transferred to the edge of the barge 54 (FIG. 6) with a view to laying the outflow pipe 42 consisting of steel tubes assembled on the barge. The end 52 of the cable is hooked onto the bottom of the frame 55 of the tilting connector 47 and the end of the first tube of the pipe 42 is connected to the connector 47. As this connection takes place on the surface, the end of this first tube may be welded to one of the ends of the connector 47, and the other end 56 of the connector may be provided with a suitable connector required for its connecting to a suitable device. It is therefore sufficient to lower the outflow pipe 42 and to tension the cable 48 for the frame 55 of the tilting connector 47 to be coupled onto the structure 46. The attachment at the end 52 of the cable 48 is released automatically either because conventional unlocking means are employed for attachment of the cable 48 to the structure 55 or because of the use of shearpins which break after the placing of the frame 55 on the structure 46 as a result of the tension exerted on the cable by the winch 51. As the connector 47 pivots about the axis 53 the laying of the outflow pipe 42 may easily be completed by displacing the barge 54 and it is sufficient to pull pipe 42 when its length is insufficient, to avoid the creation of heavy stresses at any point in the pipe. As soon as the length is sufficient the tension may be relaxed In that way the laying of steel pipe presents no difficulty. The same method may also be applied in the case of flexible pipes. When laying has been completed the pipe 42 rests on the bottom and the connector 47 in the position shown in FIGS. 8 and 9, its connector 56 presenting itself in a position similar to that of the connector 10 on the casing 9 shown in FIG. 4.

In order to highlight the similarity which exists between the connection of the station 2 to the pipe 42 (FIG. 9) and its connection to the well represented by the casing 9 (FIG. 4), the same reference numbers have been used in FIGS. 8 and 9 as those used in FIGS. 2 and 4. It is therefore unnecessary to describe again the operation of lowering the bell 18 (FIG. 8) and the operations of joining the sub-assembly 23 to the connector 56 which is equivalent to the part of the lining inside the casing 9 (FIG. 4) in which the connector 10 ensures watertightness between the lining and the casing 9 as well as the seating of the connector 20 which is fast with the connecting structure 14. It can therefore be understood that, if the outflow pipe 42 is a single pipe, the subassembly 23 may be simplified and the valve control 28, pipesystem 37 and auxiliary valve 39 may be omitted. The forms of the connectors 56 and 20 may be modified and the connector 56 may be identical in every respect with the connector 10 whilst the top end of this connection may be connected directly to a simplified sub-assembly 23. One can also provide a complex outflow pipe having an inner tube and in this case the sub assemblies 23 in FIG. 4 and 9 may be identical. The operations of lowering, joining up and connection of the sub assembly 23 having been described previously in the context of FIG. 3 it is sufficient to refer to it.

It will be observed that the angle formed by the axis of the portion of the connector 47 which is attached to the pipe 42 and by the axis of the connector 56 may not be a right angle. In this case the axis of the connector 56 coincides with the axis of the connector 20 when the connector 47 is resting against its frame 55.

In summary whether it is a matter of connection to a well or to an outflow pipe proceeding from another well, of a common pipe serving for the outflow of the products passing throught the central station, the connections of the central station to the well or to the pipe are carried out in the same manner by employing guide means carried by the platform 1 of the station 2. These guide means are thus employed for orientating a device for lateral connection carried by a structure that is connected vertically either to a well or to a tilting connector, one end of which is connected to the pipe to be connected, the orientation enabling the axis of the connecting device to be made to coincide with the axis of the lateral connector on the said central station.

What is claimed is:

1. A method of connection of a central undersea station to a group of wells and outflow pipes, wherein the station locks onto a platform provided with guide and locking means for receiving and locking said station relative thereto as well as locations for the installation of wellheads serviced by the station, said method comprising prior to connection of the wells and the pipes installing at least one guide means on said platform between the location of said station and each of the locations of said wells or pipes, lowering said central station which is provided with lateral connection means so that when said platform is locked in position said lateral connection means are opposite said guide means on said platform, lowering onto said other locations at least one placing structure and at least one connecting structure, said connecting structure being lowered by means of a diving-bell resting in a watertight manner on a bearing surface on said connecting structure, orientating said bell so that said structure presents a lateral connection means cooperating with said guide means on the said platform and a connector ensuring watertightness of the well or the said pipe with said structure, manually connecting inside said bell a sub-assembly to the lining of said well or to said pipe and at least one pipe system between said sub-assembly and said lateral connection means on said structure so as to ensure continuity of said lining or of said pipe with said lateral connection means, controlling joining of said connection means on the structure to said lateral connection means on the said central station and thereafter raising said bell.

2. A method as claimed in claim 1, wherein lateral connection of said central station to said connecting structures is facilitated by using as said lateral connection means of said station a flexible pipe in the form of a loop an end of which rests on a guide means on said platform.

3. A method as claimed in claim 1, wherein said placing structure for placing said connecting structure of a well is a male connector ensuring watertightness between the casing and the lining.

4. A method as claimed in claim 1, wherein said placing structure for placing said connecting structure of said pipe is orientated with respect to said guide means on said platform.

5. A method as claimed in claim 1, wherein the end of said pipe to be connected to said station is connected at the surface to a connector pivoting on a frame, said pipe is lowered whilst said frame supporting said connector is guided by a cable which is passed through said placing structure when locked onto its base and said frame is locked onto said structure by pulling on said cable by operation of a surface winch.

6. A method as claimed in claim 5, wherein the placing os said pipe is effected by displacement of a barge while tensioning said pipe and making said connector pivot about its axis.

7. A method of connection as claimed in claim 5, wherein said conncting structure is lowered by means of said bell after tilting of said connector about its axis.

8. Apparatus for use in carrying out the method of claim 1, comprising a base platform of a central station including at least one means for guiding a connector on a connecting structure fixed to a well or a pipe to be connected, said station including a lateral connection means facing said guide means.

9. Apparatus as claimed in claim 8, wherein said lateral connection means on the said station is formed by a loop of flexible pipe, the free end of which rests on a guide means on said platform.

10. Apparatus as claimed in claim 8, including a structure for connection of a well or a pipe including a displaceable connector resting against one of said guide means.

11. Apparatus as claimed in claim 10, wherein said connector is a pivotal connector which is attached to the end of the outflow pipe and has at its free end a connector, the axis of said connector making a certain angle with the axis of the portion of said connector attached to said pipe.

12. Apparatus as claimed in claim 11, wherein said axis of said connector of the said pivotal connector coincides with the vertical axis of said connector on said connecting structure when said connector, attached to said pipe, is abutted against its frame.

* * * * *